US007567919B1

(12) United States Patent
Koga

(10) Patent No.: US 7,567,919 B1
(45) Date of Patent: Jul. 28, 2009

(54) VEHICLE-ONBOARD ETC APPARATUS

(75) Inventor: Toshio Koga, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 1380 days.

(21) Appl. No.: 09/688,834

(22) Filed: Oct. 17, 2000

(30) Foreign Application Priority Data

Mar. 31, 2000 (JP) ..... 2000-097723

(51) Int. Cl.
*G07B 15/00* (2006.01)

(52) U.S. Cl. ..... 705/13

(58) Field of Classification Search ..... 705/1, 705/7, 13, 417; 340/933; 342/357.09, 357.1; 362/553
See application file for complete search history.

(56) References Cited

U.S. PATENT DOCUMENTS 5,864,831 A * 1/1999 Schuessler ..... 705/417
6,073,062 A * 6/2000 Hoshino et al. ..... 701/3
6,140,941 A * 10/2000 Dwyer et al. ..... 340/928
6,252,524 B1 * 6/2001 Takikita ..... 340/933
6,259,376 B1 * 7/2001 Fuyama ..... 340/928
6,429,812 B1 * 8/2002 Hoffberg ..... 342/357.1
6,491,420 B1 * 12/2002 Scifres ..... 362/553
6,657,554 B1 * 12/2003 Terashima et al. ..... 340/928
6,680,694 B1 * 1/2004 Knockeart et al. ..... 342/357.09
6,834,267 B1 * 12/2004 Fuyama ..... 705/13

FOREIGN PATENT DOCUMENTS

WO WO 96/11452 * 4/1996

OTHER PUBLICATIONS

Exacting a toll: GPS, microwave precise Swiss System. (Integration Challenge). GPS World, v 14, n 6, p. 16, Jun. 2003.*

* cited by examiner

*Primary Examiner*—Susanna M Diaz
(74) *Attorney, Agent, or Firm*—Sughrue Mion, PLLC

(57) ABSTRACT

A vehicle-onboard ETC apparatus capable of conducting ETC information communication includes a vehicle speed detector for detecting a speed of a motor vehicle which passes through a toll gate station equipped with an ETC system, a communication unit for exchanging ETC information for settlement of toll charge/payment with the toll gate station upon passing therethrough, a measuring unit for measuring reception field intensity of the received ETC information within a communication coverage area, and a decision unit for making decision on the basis of the detected vehicle speed and the measured reception field intensity as to a location within the communication coverage area where ETC information communication can be started while sustaining favorable field intensity for signal reception at the detected vehicle speed, to thereby allow the communication means to perform communication processing on the basis of the result of the above decision.

7 Claims, 7 Drawing Sheets

VEHICLE-ONBOARD ETC APPARATUS

BACKGROUND OF THE INVENTION

1. Field of the Invention

The present invention relates to an electronic toll collection system (hereinafter also referred to as the ETC system in short). More particularly, the present invention is concerned with an ETC apparatus which is mounted on a motor vehicle (this apparatus will hereinafter be referred to as the vehicle-onboard ETC apparatus), which apparatus is so designed as to be capable of setting a timing for communication of electronic toll collection information or ETC information with a toll gate station equipped with the ETC system on the basis of a vehicle-speed detection signal of the motor vehicle.

2. Description of Related Art

For having better understanding of the principle underlying the present invention, description will first be made in some detail of the conventional vehicle-onboard ETC apparatus known heretofore.

FIG. 6 of the accompanying drawings is a block diagram showing schematically a general arrangement of a hitherto known vehicle-onboard ETC apparatus. Referring to the figure, reference numeral 1 denotes an antenna mounted on a motor vehicle (hereinafter referred to as the vehicle-mounted antenna) for interchanging or exchanging (i.e., receiving/sending) the ETC-relevant information such as toll gate position information, toll charge/payment information, ID code information inherent or specific to the motor vehicle and the like with a toll collection transaction antenna (also referred to as the on-road overhead antenna) installed at a toll gate station of a toll road (not shown). Further, reference numeral 2 denotes a cable for the vehicle-onboard ETC apparatus (hereinafter this cable will be referred to as the vehicle-mounted cable) through which the ETC information is conveyed from the vehicle-mounted antenna 1 to a vehicle-onboard ETC apparatus 10 described below and vice versa.

As can be seen in FIG. 6, the vehicle-onboard apparatus 10 is comprised of a transmitter/receiver unit 3 for interchanging by radio waves the ETC information with a corresponding unit of the ETC system installed at the toll gate station through the medium of the vehicle-mounted antenna 1 and the on-road overhead antenna (not shown), a control unit 4 for generating the ETC information to be sent to the toll gate station through the transmitter/receiver unit 3 while processing the ETC information received through the transmitter/receiver unit 3 into a signal for displaying a corresponding image, a manipulating unit 8 for performing signal input/output operations, input/output signal gain setting operations and others for the control unit 4, a display device 5 designed for displaying the received ETC information as an image while displaying the ETC information sent to the toll gate from the vehicle-onboard ETC apparatus as an image for the monitoring purpose, a voice-output unit 6 for outputting in voice the received ETC information through a speaker 9, and a power supply source 7.

Parenthetically, the manipulating unit 8, the display device 5, the voice-output unit 6 and the speaker 9 cooperate to constitute a man-machine interface unit 11 which serves an intermediation medium for enabling communication between the vehicle-onboard ETC apparatus 10 and the driver of the motor vehicle.

FIG. 7 is a block diagram showing generally a circuit arrangement of the transmitter/receiver unit 3 known in the art. Incidentally, like reference numerals as those shown in FIG. 6 denote like or equivalent parts.

Referring to the figure, the transmitter/receiver unit 3 is comprised of a detector diode D for detecting the ETC information signal emitted from the toll collection transaction antenna A1 (on-road overhead antenna) installed at a toll gate TG and received by the vehicle-mounted antenna 1, a detecting circuit 3-1 for detecting the level of the received signal as detected by the detector diode D, a demodulating circuit 3-2 for demodulating the received signal as detected to thereby restore the original ETC information which is then supplied to the control unit 4 as the received data, and a modulating circuit 3-3 for modulating the ETC information outputted from the control unit 4 into a signal which is then fed to the vehicle-mounted antenna 1.

In this conjunction, it should be mentioned that the control unit 4 is so designed as to process the ETC information acquired after demodulation through the demodulating circuit 3-2 when the detection signal of a level higher than a predetermined level is received. More specifically, the ETC information sent from the overhead antenna A1 is received by the vehicle-onboard ETC apparatus to be processed by the control unit 4, only when the electric field intensity of the radio waves carrying the ETC information is higher than a predetermined level. In this way, communication between the vehicle-onboard ETC apparatus and the ETC equipment installed at the toll gate TG can be carried out within a narrow range of radio-wave coverage area (service area), while erroneous communication with an adjacent antenna (i.e., other on-road overhead antenna) can be excluded. Thus, the toll collection or toll charge/payment transaction can be carried out essentially without fail.

Next, description will turn to operation of the conventional vehicle-onboard ETC apparatus of the structure described above.

By way of example, it is assumed that a motor vehicle or car equipped with the ETC apparatus 10 runs beneath the overhead antenna A1 installed at the toll gate TG. Then, the vehicle-onboard ETC apparatus 10 receives the radio wave signal carrying the information concerning the toll gate identifier which the motor vehicle currently is passing through and the toll collection information code from the ETC equipment installed at the toll gate through the overhead antenna A1 and the vehicle-mounted antenna 1. The control unit 4 incorporated in the vehicle-onboard ETC apparatus 10 processes the received signal to recognize discriminatively the toll gate identifier as well as the toll collection information code, the results of which are displayed as visible information or image on the display device 5 or alternatively messaged as the voice information from the speaker 9 driven by the voice-output unit 6.

The driver of the car can thus confirm that his or her car is passing through a toll gate station concerned and that the toll collection processing (i.e., toll charge/payment processing) has been started by observing the screen image on the display device 5 or hearing the voice message outputted from the speaker 9.

Furthermore, upon identification of the toll collection code being received, the control unit 4 reads out the information such as the ID number intrinsic to the motor vehicle or car concerned from an internal memory (not shown), which information is then supplied to the modulating circuit 3-3 to be thereby modulated for transmission to the toll collection overhead antenna A1 of the toll gate TG from the vehicle-mounted antenna 1.

The ETC equipment installed at the toll gate TG recognizes discriminatively the information such as the ID number or the like, whereon the processing for settlement of the toll charge/ payment is automatically executed for the bank account of the owner of the motor vehicle passing through the toll gate TG.

As will now be appreciated from the foregoing description, with the conventional vehicle-onboard ETC apparatus, the ETC information transferred between the ETC apparatus of the motor vehicle and the ETC equipment of the toll gate station through radio-wave communication can be recognized by the driver by viewing the images generated on the display device or hearing the voice information outputted from the speaker. This however means that the driver's attention tends to be attracted to the information concerning the transactions with the toll gate station, depriving the driver of his or her attention in the forward direction in which the motor vehicle is running, which of course is undesirable particularly when the motor vehicles have to pass through the toll gate station of the toll road at a relatively high speed in order to avoid traffic jam.

The coverage of the radio wave emitted from the toll collection antenna (i.e., service area of the toll gate station over which communication of the ETC information is possible) is set narrow on the order of 3 m×4 m or so with a view to avoiding interference with the service area of other toll gate station. As a consequence, there may arise such situation that the motor vehicle passes through the service area without conducting communication with the toll gate station for a sufficient time although it depends on the speed of the motor vehicle entering the service area, thus giving rise to a problem that the ETC information can not be sufficiently exchanged or transferred between the motor vehicle and the toll gate station.

On the other hand, when the speed of the motor vehicle entering the service area is low due to traffic jam, a lot of time will be taken for the motor vehicle to pass through a communication-disabled region which may take place due to change of the field strength or intensity in the vicinity of the boundary between the communication-capable area and the communication-incapable area under the influence of ratio-wave disturbance phenomenon such as Rayleigh fading. When the communication-disabled period continues long and when the number of times the communication is retried exceeds a predetermined value, then the communication between the ETC equipment of the toll gate station and the vehicle-onboard ETC apparatus can no more be restored. Moreover, the facility of the motor vehicle for the ETC information communication is invalidated in succession, to another great disadvantage.

SUMMARY OF THE INVENTION

In the light of the state of the art described above, it is an object of the present invention to provide a vehicle-onboard ETC apparatus which is capable of conducting communication of the ETC information while maintaining favorably the reception field intensity by setting the position for starting the ETC information communication within the service area in dependence on the speed at which the motor vehicle enters the service area or ETC information communication area.

In view of the above and other objects which will become apparent as the description proceeds, there is provided according to a general aspect of the present invention a vehicle-onboard ETC apparatus which includes a vehicle speed detecting means for detecting a speed of a motor vehicle which passes through a toll gate station equipped with an ETC system, a communication means for transferring ETC information for settlement of toll charge/payment transaction with the toll gate station upon passing therethrough, a measuring means for measuring reception field intensity of the received ETC information within a communication coverage area, and a decision means for making decision on the basis of the detected vehicle speed and the measured reception field intensity as to a location within the communication coverage area where ETC information communication can be started while sustaining favorable reception field intensity at the detected vehicle speed, to thereby allow the communication means to perform communication processing on the basis of result of the decision.

By virtue of the arrangement of the vehicle-onboard ETC apparatus described above, the ETC information interchanging or transaction can be realized in a stable state while sustaining favorable field intensity for reception of the information signal nevertheless of whether the motor vehicle enters the communication coverage area at a high or low speed.

In a preferred mode for carrying out the invention, the decision means may be so designed as to sample distance data which ensure more favorable reception field intensity than the reception field intensity at an entrance location of the communication coverage area on the basis of speed at which the motor vehicle enters the communication coverage area, to thereby generate distance-versus-reception field intensity data.

In another preferred mode for carrying out the invention, the decision means may be so designed as to determine the distance data which can ensure favorable reception field intensity through statistical processing on the basis of speed at which the motor vehicle enters the communication coverage area.

In yet another preferred mode for carrying out the invention, the above-mentioned decision means may be so designed as to convert the distance data to time data based on area entering speed.

In still another preferred mode for carrying out the invention, the vehicle-onboard ETC apparatus may further include an image display means for displaying the ETC information exchanged through the communication means as an image while stopping display of the ETC information in dependence on a vehicle speed signal outputted from the vehicle speed detecting means.

With the arrangement of the vehicle-onboard ETC apparatus described above, safety operation or careful driving can be ensured which preventing driver's attention from being attracted concentratively to the screen display.

In a further preferred mode for carrying out the invention, the vehicle-onboard ETC apparatus may further include a voice output means for generating a synthesized voice message signal for prompting change of speed of the motor vehicle in dependence on a vehicle speed signal outputted from the vehicle speed detecting means, for thereby outputting the message in voice.

Owing to the arrangement of the vehicle-onboard ETC apparatus described above, safety operation or careful driving can be ensured.

The above and other objects, features and attendant advantages of the present invention will more easily be understood by reading the following description of the preferred embodiments thereof taken, only by way of example, in conjunction with the accompanying drawings.

BRIEF DESCRIPTION OF THE DRAWINGS

In the course of the description which follows, reference is made to the drawings, in which.

DESCRIPTION OF THE PREFERRED EMBODIMENTS

Figure 1:
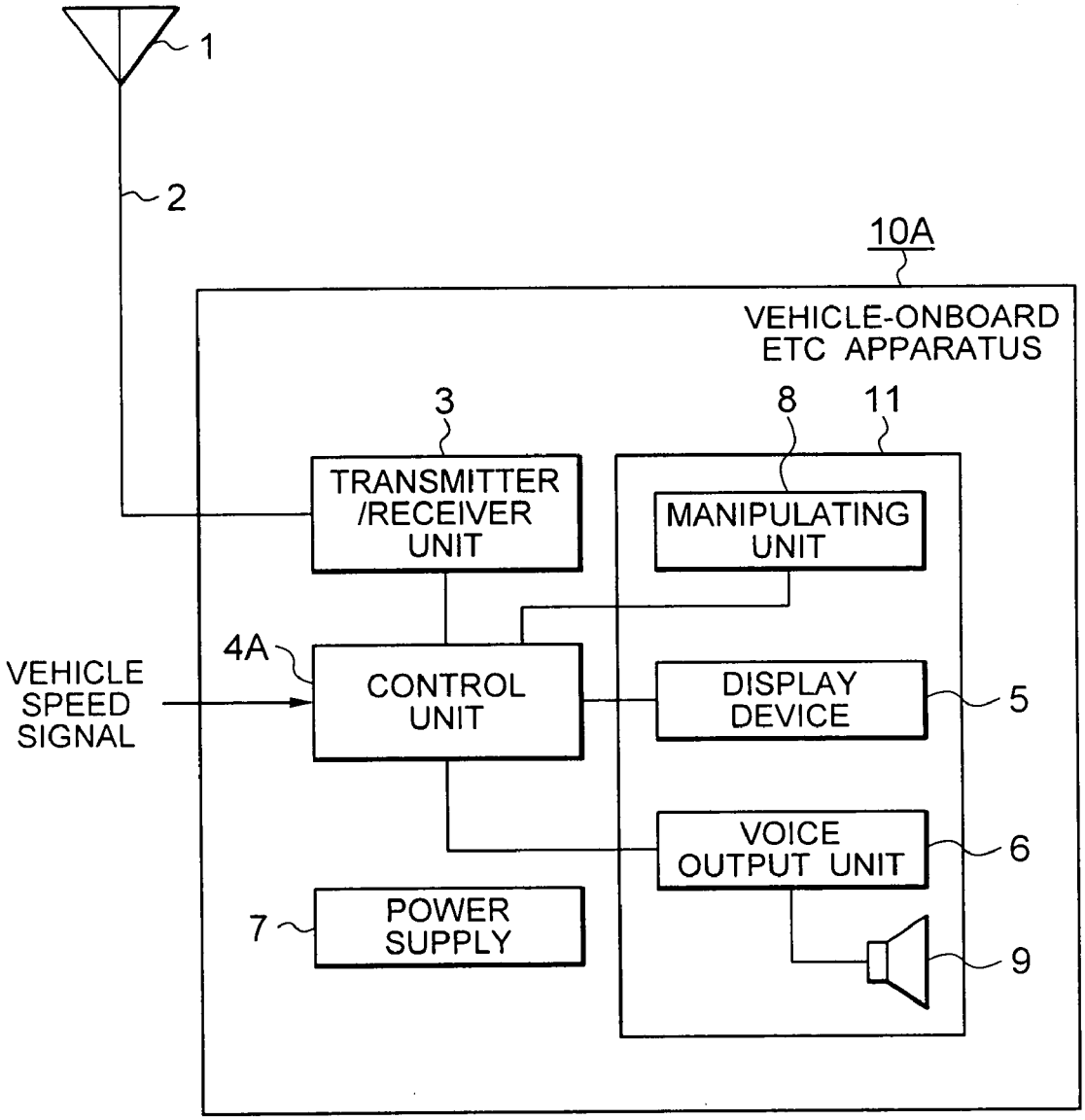
FIG. 1 is a block diagram showing generally a structure of a vehicle-onboard ETC apparatus according to a first embodiment of the present invention.

The present invention will be described in detail in conjunction with what is presently considered as preferred or typical embodiments thereof by reference to the drawings. In the following description, like reference characters designate like or corresponding parts throughout the several views.

Embodiment 1

FIG. 1 is a block diagram showing generally a structure of the vehicle-onboard ETC apparatus according to a first embodiment of the present invention.

Referring to the figure, the vehicle-onboard ETC apparatus according to the first embodiment of the invention and denoted generally by reference character 10A includes a control unit 4A which has in addition to the functions of the control unit 4 of the conventional vehicle-onboard ETC apparatus 10 described hereinbefore such a function for generating distance-versus-reception field intensity data to determine on the basis of the vehicle speed signal inputted from a vehicle speed sensor (not shown) the distance over which the motor vehicle has run within the service area and which can ensure communication of the ETC information at a favorable reception field intensity, for thereby setting the timing for starting processing of the received ETC information signal on the basis of the above-mentioned distance-versus-reception field intensity data.

Figure 2:
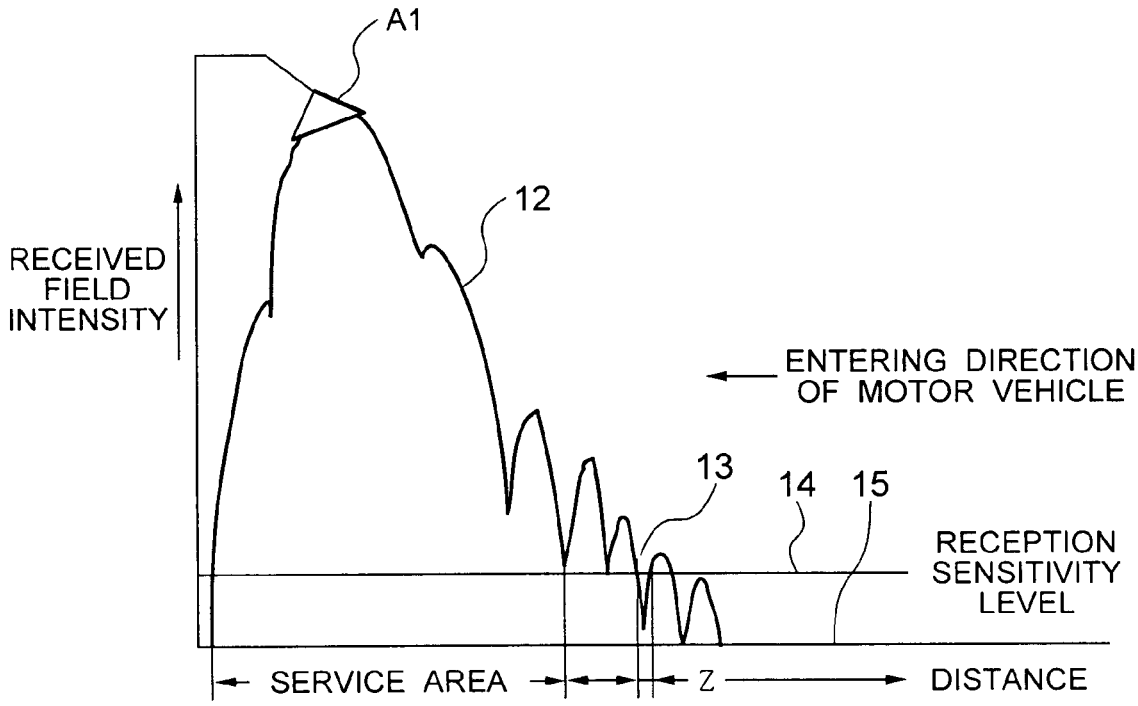
FIG. 2 is a view for illustrating schematically a field intensity distribution around an overhead antenna of an ETC equipment installed at a toll gate.

At first, the basis underlying the vehicle-onboard ETC apparatus according to the invention will be elucidated. As is illustrated in FIG. 2, the field intensity distribution around the overhead antenna for toll collection installed at a passage gate of, for example, a toll station is ordinarily of such a pattern that as the distance from a point just beneath the overhead antenna A1 increases in the horizontal direction, the reception field intensity becomes attenuated progressively while being intensified and enfeebled repetitionally and finally becomes lower than the reception sensitivity level (threshold level) 14 at which the reception of the ETC information can be decided. This can be explained by the fact that the radio wave emitted from the overhead antenna A1 are not completely absorbed by the road surface 15 but gradually attenuated, being reflected repetitively on the road surface 15. Further, around the distal ends or sides of the service area, there makes appearance a communication-disabled region in the vicinity of the boundary between the communication-incapable area 13 where the reception field intensity lowers steeply beyond the aforementioned threshold level and the communication-capable area where the reception field intensity again increases beyond the threshold level.

In the communication of the ETC information between the vehicle-onboard ETC apparatus and the ETC equipment of the toll gate station through the medium of the overhead antenna A1 and the vehicle-mounted antenna, communication of the ETC information can be carried out with a favorable reception field intensity level at a location close to a position just beneath the overhead antenna A1. However, in case the motor vehicle enters the service area at a relatively low speed due to traffic jam or for other reason, there may take place such unwanted situation that the motor vehicle assumes a position within the communication-disabled region Z mentioned above when it is decided on the basis of the reception sensitivity of the ETC information received at the time point the motor vehicle entered the service area that the vehicle-onboard ETC apparatus is in the state for performing the ETC information communication with the ETC equipment of the toll gate station. As described hereinbefore, in the communication-disabled region, the vehicle-onboard ETC apparatus can not receive the ETC information emitted from the overhead antenna of the toll gate.

In that case, the ETC equipment installed at the toll gate station will carry out a so-called retry operation for sending the ETC information to the motor vehicle repetitively over a great number of times with an attempt for establishing the communication line with the vehicle-onboard ETC apparatus. However, when the number of the retry operations for establishing the communication line has exceeded a prescribed number of times (on the order of one to two hundred times), then unauthorized or illegal use of the vehicle-onboard ETC apparatus is decided, as a result of which none of the toll gate stations does accept the ETC information any more.

Such being the circumstances, when the speed of the motor vehicle is low, it is preferred to perform the ETC information communication at the time point when the motor vehicle has passed through the communication-disabled region and reached a location where favorable reception field intensity prevails. By contrast, the motor vehicle entering the service area at a relatively high speed will pass through the communication-disabled region before the number of retry operations attains the prescribed number, to reach a location where the reception field intensity is favorable. Thus, the ETC apparatus of this motor vehicle can start the ETC information communication operation at a time point at which the ETC information signal of the level higher than the threshold level is detected. Further, the ETC information communication should be started at an earlier time point when the motor vehicle speed is high, because otherwise the motor vehicle will have passed through the area where the reception field intensity is favorable before the ETC information communication has been completed or because the ETC information communication will be started at a location where the reception field intensity becomes attenuated, incurring the possibility of the toll collection information communication being unsuccessfully completed.

The present invention is based on the observations elucidated above.

Figure 3:
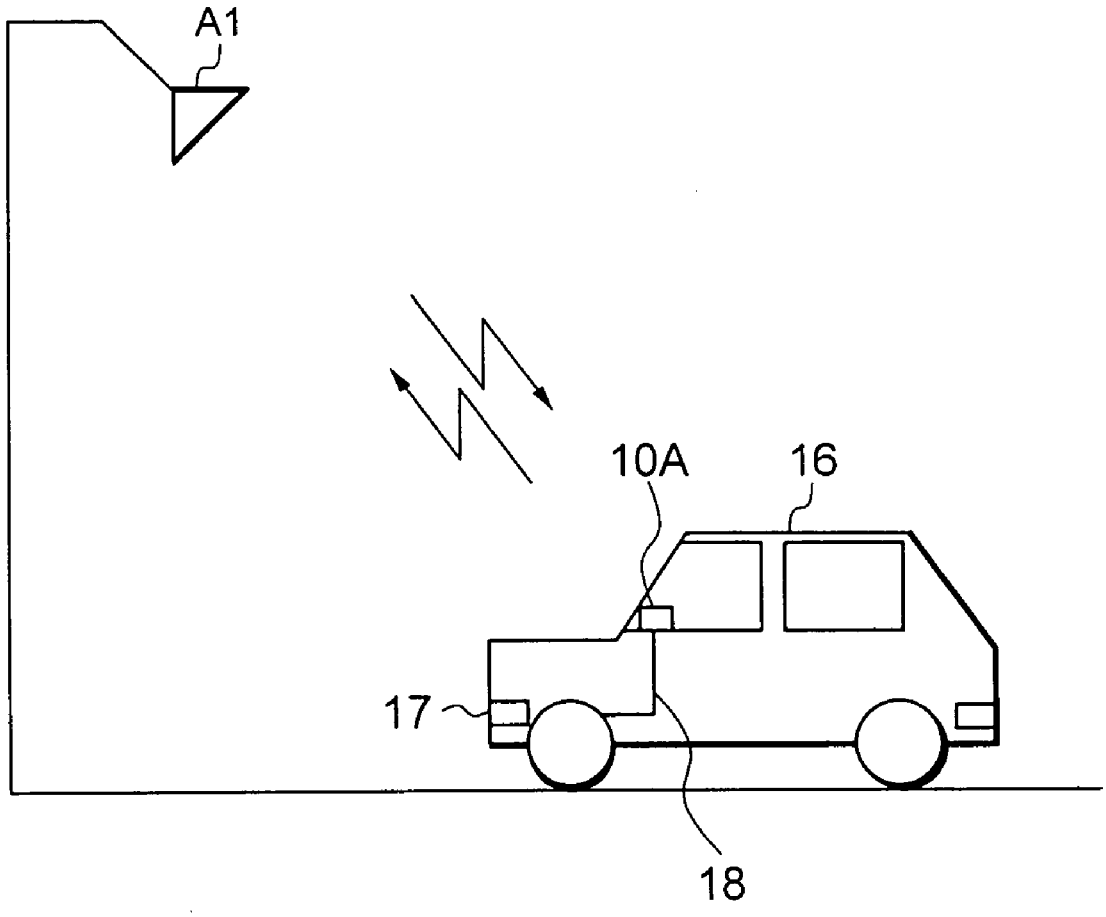
FIG. 3 is a block diagram showing generally a configuration of an ETC system in which a vehicle-onboard ETC apparatus provided with a vehicle-speed signal detecting means is employed according to the first embodiment of the present invention.
Figure 4:
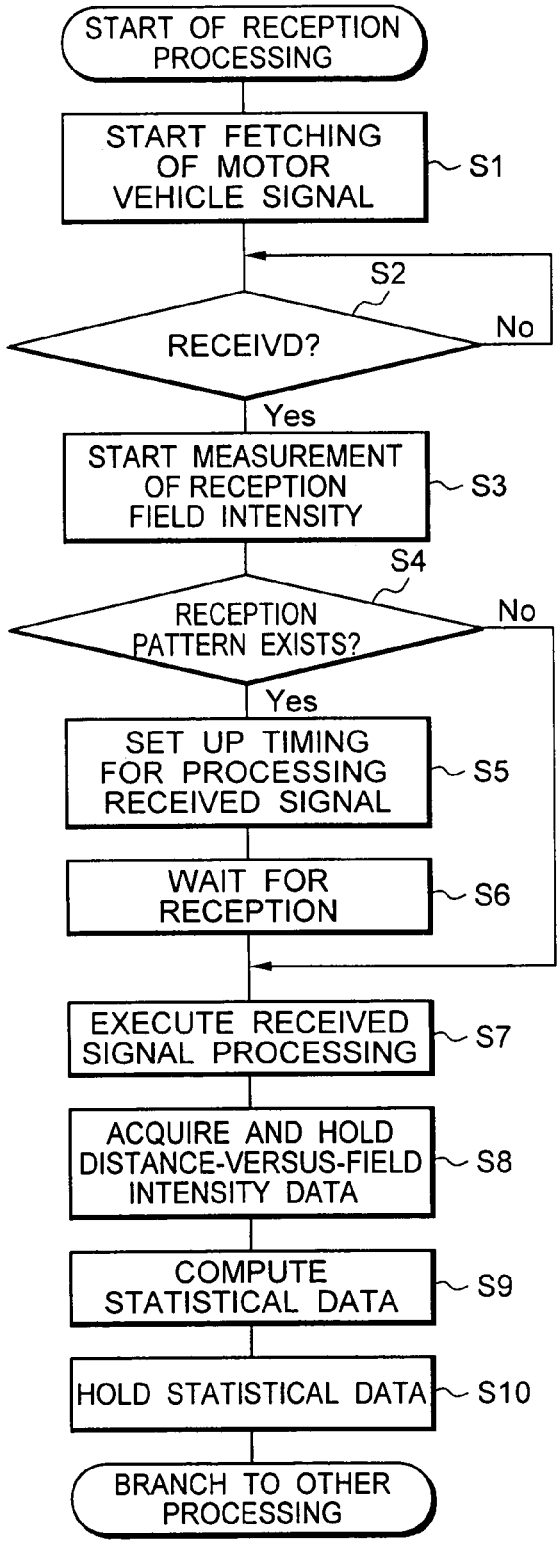
FIG. 4 is a flow chart for illustrating processings involved in ETC information communication and executed by a control unit incorporated in the vehicle-onboard ETC apparatus according to the present invention.
Figure 5:
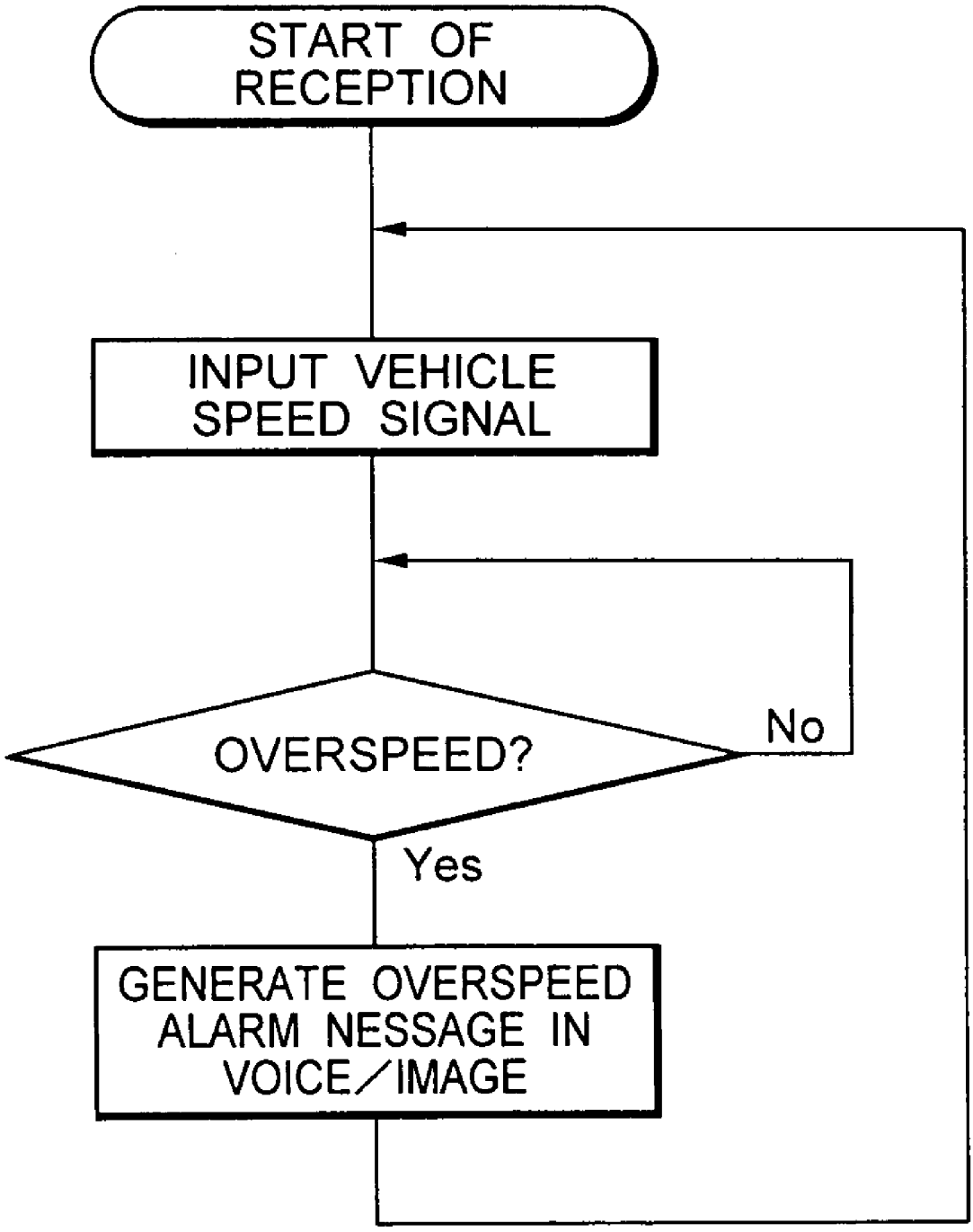
FIG. 5 is a flow chart for illustrating overspeed voice alarm generating processing executed in the vehicle-onboard ETC apparatus according to a second embodiment of the present invention.
Figure 6:
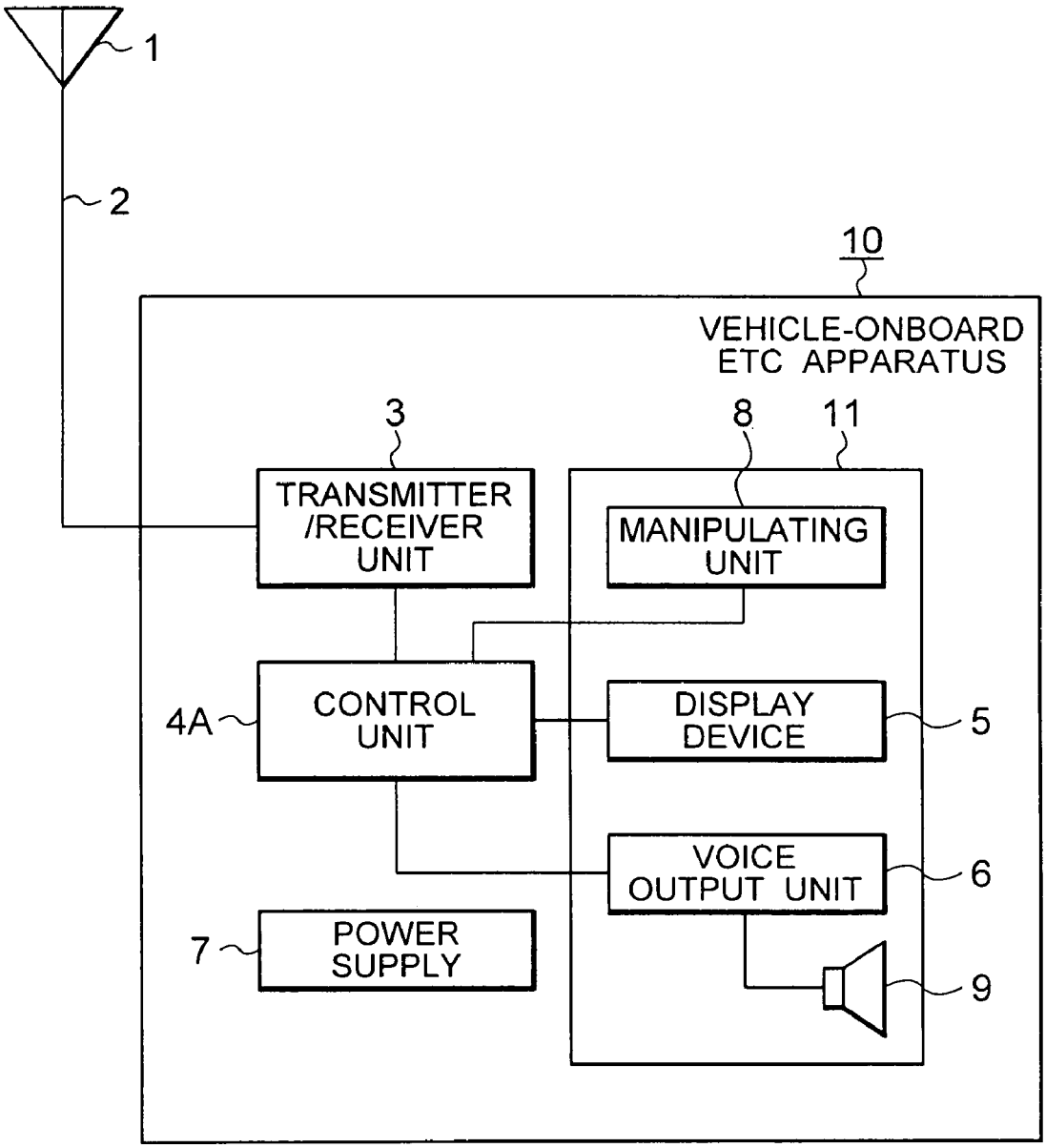
FIG. 6 is a block diagram showing a structure of a conventional vehicle-onboard ETC apparatus.
Figure 7:
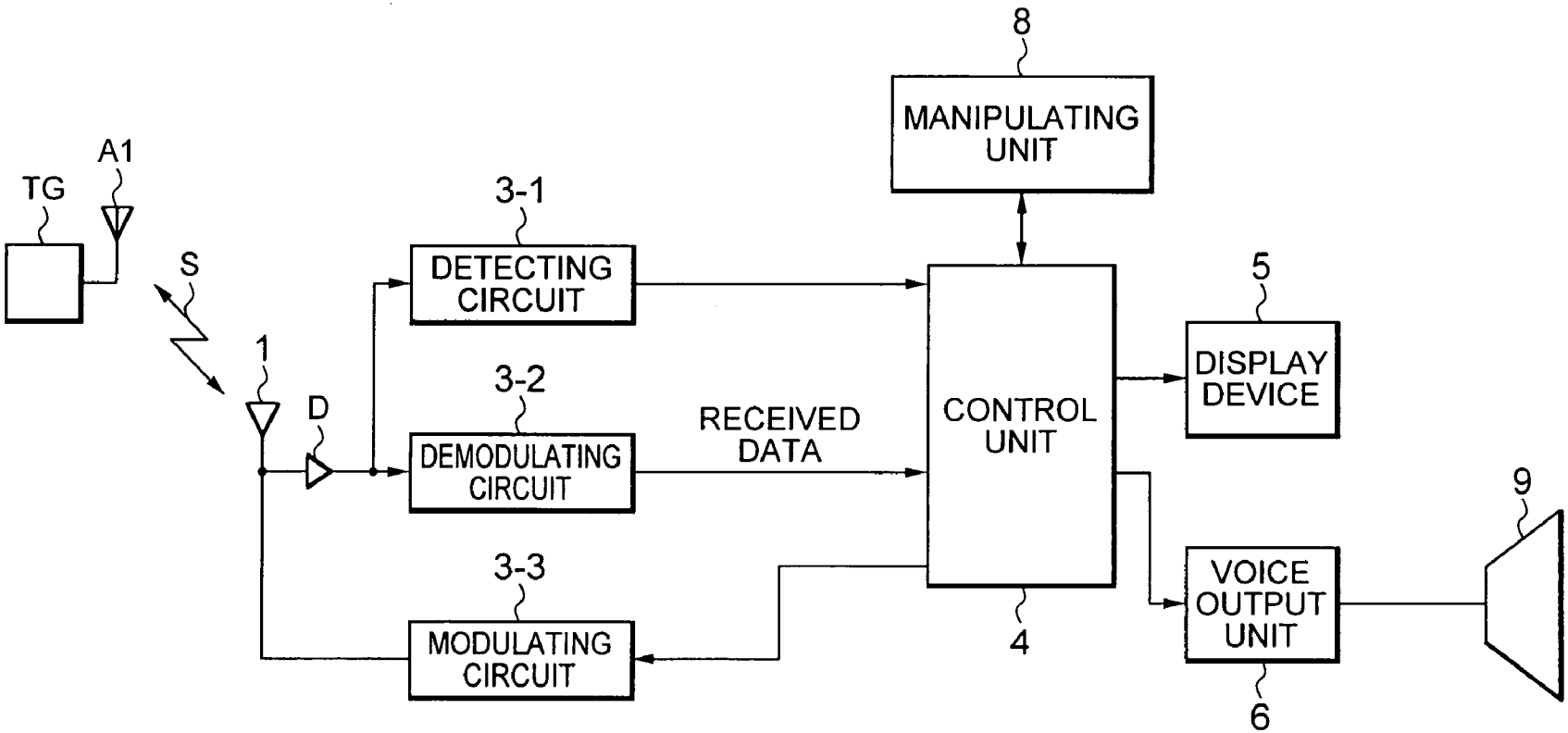
FIG. 7 is a block diagram showing a configuration of a transmitter/receiver unit incorporated in the conventional vehicle-onboard ETC apparatus.

Now, description will be directed to operation of the vehicle-onboard ETC apparatus according to the first embodiment of the present invention by reference to FIGS. 3 and 4.

FIG. 3 is a view showing generally a configuration of the ETC system in which the vehicle-onboard ETC apparatus equipped with a vehicle speed signal input means is employed. As can be seen in FIG. 3, the motor vehicle 16 is equipped with the vehicle-onboard ETC apparatus 10A and a vehicle speed sensor 17 for generating a vehicle speed signal (i.e., signal indicative of the speed of the motor vehicle) which is supplied to the vehicle-onboard ETC apparatus 10A by way of a vehicle-speed signal line 18.

FIG. 4 is a flow chart for illustrating processings for reception of the ETC information in the vehicle-onboard ETC apparatus according to the instant embodiment of the invention. At first, it is to be mentioned that the ETC information signal reception processing is repetitively carried out every time the motor vehicle enters the ETC communication area or service area. The gist of the ETC information signal reception processing resides in arithmetical determination of statistical data of the reception field intensity corresponding to the distance for which the motor vehicle has traveled within the service area by using the vehicle speed as a parameter to thereby determine on the basis of the statistical data the time point at which the ETC information communication can be started at a high reception field intensity level. The above-mentioned distance depends on the speed at which the motor vehicle enters the service area (ETC communication area).

Operation of the vehicle-onboard ETC apparatus is started upon closing of the engine key. At that time point, the microcomputer incorporated in the control unit 4A starts the signal reception processing while fetching the vehicle speed signal from the output of the vehicle speed sensor 17 (step S1). The microcomputer receives a signal having a frequency indicative of the ETC information from the transmitter/receiver unit 3. At this time point, decision is made as to whether the level of the received signal is a prescribed one (reception sensitivity level 14, see FIG. 2) which indicates the entry of the motor vehicle into the service area (step S2). When it is decided that the received signal is not at the prescribed level, the signal reception processing is again started. Upon reception of the signal of the prescribed level, measurement of the reception field intensity is started (step S3).

In this conjunction, it should be mentioned that the measurement of the reception field intensity is performed on the basis of the level of the signal received by the transmitter/receiver unit 3.

Once the reception field intensity measurement has been started, it is then decided that the reception pattern, i.e., pattern of the reception field intensities corresponding to the distance the motor vehicle has traveled within the service area with the vehicle speed being taken as the parameter, is set or not (step S4). In the initial state of the signal reception processing, the statistical data are not yet sampled with the reception pattern being not yet set up.

In the case where the reception pattern is not yet setup, the ETC information communication is performed with the ETC equipment of the toll gate station without setting the received signal processing timing which represents the timing (distance/vehicle speed) for receiving the ETC information conforming to the vehicle speed, whereon the toll collection processing (toll charge/payment processing) is performed by processing the information signal received through the ETC information communication with the toll gate (step S7).

The received signal processing further includes distance-versus-reception field intensity data generating processing in the succeeding steps. More specifically, there are provided a processing for arithmetically determining the distance over which the motor vehicle has moved during a period from a time point when the entry of the motor vehicle in the service area was detected to a time point when the ETC information communication is started on the basis of the vehicle speed signal derived from the output of the vehicle speed sensor and a processing for detecting the reception field intensity at the ETC information communication starting time point on the basis of the ETC information signal level.

The signals processed are held as the distance-versus-field intensity data with the vehicle speed being selected as the parameter (step S8). The processings in the steps S1 to S3, S7 and S8 mentioned above are repetitively executed every time the motor vehicle enters the service area of the toll gate station where the ETC system is installed. When a number of data sufficient for the aimed statistical processing have been held, the distance at which the highest reception field intensity is available is arithmetically determined on a vehicle-speed basis as the statistical data (step S9). The statistical data determined arithmetically in this manner are held (stored) to be subsequently made use of for generating or preparing the reception patterns (step S10).

At this juncture, with the phrase "reception pattern", it is contemplated to mean a corresponding pattern of the reception field intensities which correspond to the distances over which the motor vehicle has traveled every time it entered the service area with the vehicle speed being used as the parameter.

Incidentally, it should be mentioned that the amount of the statistical data increases as the signal reception processing described above is repeated, which in turn means that the accuracy of the statistical processing can then be enhanced correspondingly.

Once the reception pattern has been generated on the basis of the statistical data by executing repetitionally the signal reception processing described above (step S4), then in the succeeding signal reception processing, the reception pattern is referenced on the basis of the vehicle speed signal after measurement of the reception field intensity in the step S7, to thereby search or retrieve the distance at which the ETC information communication can be carried out at the favorable reception field intensity level when the motor vehicle enters the service area at the vehicle speed mentioned above.

When the vehicle speed and the distance which can ensure the ETC information communication at the favorable level have been determined, the distance is then converted to the time taken for the motor vehicle to travel over that distance, whereon the communication start timing (received signal processing timing) measured from the time point at which the motor vehicle entered the service area (i.e., since the service area entry time point) is set (step S5). Once the received signal processing timing has been established, the vehicle-onboard ETC apparatus can thereafter perform the ETC information signal receiving processing after the time measured from the time point at which the motor vehicle entered the service area has reached the ETC information communication starting timing (received signal processing start timing) (steps S6 and S7).

As will now be understood from the foregoing description, with the teachings of the present invention incarnated in the vehicle-onboard ETC apparatus according to the first embodiment, the vehicle speed at which the ETC information communication can be performed at favorable field intensity level as well as the communication area or coverage corresponding to the vehicle speed can be estimated with high accuracy and reliability. Further, by estimating the communication area or coverage in this way, influence of the radio-wave conditions to the communication state can be suppressed to a possible minimum, whereby the retry operation described hereinbefore can be avoided.

Embodiment 2

In the case of the vehicle-onboard ETC apparatus according to the first embodiment of the present invention, the speed signal of the motor vehicle is used for estimating the coverage area of the ETC information. In the vehicle-onboard ETC apparatus according to a second embodiment of the invention, the speed signal of the motor vehicle is utilized for prompting the driver of safety operation or careful driving.

As mentioned previously, when the motor vehicle passes by the toll gate station of a high way equipped with the ETC system while maintaining a constant speed, attention of the driver tends to be attracted to the ETC information displayed on the display device 5 rather than to the forward direction in which the motor vehicle is running which is not preferable particularly when the motor vehicle is running on a high way.

Thus, according to the present invention incarnated in the second embodiment thereof, it is taught to forcibly inhibit the information display on the display device 5 in response to inputting of the vehicle speed signal to the control unit 4A. Furthermore, the ETC information interchanged in the course of running on the high way is enforcively stored in the internal memory of the control unit 4A so that the ETC information can be read out to be displayed on the display device 5 upon stoppage of the motor vehicle, as occasion requires.

Embodiment 3

In the vehicle-onboard ETC apparatus according to a third embodiment of the invention, the speed signal is utilized as a control signal for outputting from the voice-output unit a voice message for prompting the driver of safety operation and for displaying similar message on the display device 5.

In more concrete, in the toll gate station equipped with the ETC system, the communication validating time period can not be ensured when the motor vehicle passes through the service area at a high speed which exceeds a prescribed speed, incurring degradation in the communication state. Furthermore, overspeed driving of the motor vehicle may lead to occurrence of collision or car crash and contact or traction accident.

In the vehicle-onboard ETC apparatus according to the third embodiment of the invention, the control unit 4A is so arranged as to fetch the speed signal as a control signal. When the speed signal as fetched indicates that the current motor vehicle speed exceeds a prescribed level, then a synthesized voice signal messaging "speed is over" is generated to be supplied to the voice-output unit 6, as a result of which a voice alarm "speed is over" is produced from the speaker 9. Further, similar message may be displayed on the display device 5.

When the speed of the motor vehicle passing through the service area of the toll gate station is low, a lot of time is taken for the motor vehicle to run through the communication-disabled region Z which may make appearance in the vicinity of the boundary between the communication-capable area and the communication-incapable area due to variations of the field intensity under the influence of ratio-wave disturbance such as Rayleigh fading phenomenon illustrated in FIG. 2. As a result of this, in the ETC equipment installed at the toll gate station, the retry operation mentioned hereinbefore will be repeated in an attempt to establish the communication line with the motor vehicle, which incurs degradation of the communication state.

Accordingly, in order to exclude such situation as described above, the control unit 4A fetches the speed signal. When the speed signal as fetched indicates that the current motor vehicle speed does not exceed a prescribed level, e.g. in the order of 10 km/h, then a synthesized voice signal messaging "speed is down" is generated to be supplied to the voice-output unit 6, as a result of which a voice alarm "speed is down" is produced from the speaker 9. Further, similar message may be displayed on the display device 5.

Many modifications and variations of the present invention are possible in the light of the above techniques. It is therefore to be understood that within the scope of the appended claims, the invention may be practiced otherwise than as specifically described.

What is claimed is:

1. A vehicle-onboard electronic toll collection apparatus, comprising:

(a) vehicle speed detecting means for detecting a speed of a motor vehicle which passes through a toll gate station equipped with an electronic toll collection system;

(b) communication means for exchanging electronic toll collection information for settlement of toll charge/payment transaction with said toll gate station upon passing through said toll gate station;

(c) measuring means for measuring reception field intensity of the received electronic toll collection information within a communication coverage area; and (d) decision means for making decision on the basis of said detected vehicle speed and said measured reception field intensity as to a location within said communication coverage area where electronic toll collection information communication can be started while sustaining favorable reception field intensity at said detected vehicle speed, to thereby allow said communication means to perform communication processing on the basis of result of said decision, wherein said vehicle-onboard electronic toll collection apparatus comprises elements (a)-(d), and wherein said elements (a)-(d) are provided on a vehicle.

2. An vehicle-onboard electronic toll collection apparatus according to claim 1, wherein said decision means is so designed as to sample distance data which ensure more favorable reception field intensity than the reception field intensity at an entrance location of said communication coverage area on the basis of speed at which said motor vehicle enters said communication coverage area, to thereby generate distance-versus-reception field intensity data.

3. An vehicle-onboard electronic toll collection apparatus according to claim 2, wherein said decision means is so designed as to determine said distance data which can ensure favorable reception field intensity through statistical processing on the basis of speed at which said motor vehicle enters said communication coverage area.

4. An vehicle-onboard electronic toll collection apparatus according to claim 2, wherein said decision means is so designed as to convert the distance data to time data based on area entering speed.

5. An vehicle-onboard electronic toll collection apparatus according to claim 3, wherein said decision means is so designed as to convert the distance data to time data based on area entering speed.

6. An vehicle-onboard electronic toll collection apparatus according to claim 1, further comprising:

image display means for displaying the electronic toll collection information exchanged through said communication means as an image while stopping display of the electronic toll collection information in dependence on a vehicle speed signal outputted from said vehicle speed detecting means.

7. An vehicle-onboard electronic toll collection apparatus according to claim 1, further comprising:

voice output means for generating a synthesized voice message signal for promoting change of speed of the motor vehicle in dependence on a vehicle speed signal outputted from said vehicle speed detecting means, for thereby outputting said message in voice.

* * * * *